US006460517B1

(12) United States Patent
Dauer

(10) Patent No.: US 6,460,517 B1
(45) Date of Patent: Oct. 8, 2002

(54) CANISTER PURGE SYSTEM

(75) Inventor: Kenneth John Dauer, Avon, NY (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/754,620

(22) Filed: Jan. 4, 2001

(51) Int. Cl.[7] ..... F02M 33/02
(52) U.S. Cl. ..... 123/520; 123/516
(58) Field of Search ..... 123/520, 519, 123/518, 516, 90.15, 90.16; 73/118.1

(56) References Cited

U.S. PATENT DOCUMENTS 4,203,401 A 5/1980 Kingsley et al.
4,308,842 A * 1/1982 Watanabe et al. ..... 123/520
4,671,071 A * 6/1987 Sasaki ..... 62/54
5,056,494 A * 10/1991 Kayanuma ..... 123/519
5,103,877 A 4/1992 Sherwood et al.
5,143,035 A * 9/1992 Kayanuma ..... 123/198 D
5,190,015 A * 3/1993 Nakata et al. ..... 123/520
5,371,412 A * 12/1994 Iwashita et al. ..... 290/1 R
5,762,692 A 6/1998 Dumas et al.
6,136,075 A 10/2000 Bragg et al.

* cited by examiner

*Primary Examiner*—Willis R. Wolfe
*Assistant Examiner*—Mahmoud Gimie
(74) *Attorney, Agent, or Firm*—Patrick M. Griffin

(57) ABSTRACT

A canister purge system for throttleless internal combustion engine intake systems includes a plurality of purge ports, each of which is adapted for connection to an intake port of an internal combustion engine. An evaporative emissions canister is in fluid connection with each purge port. Each purge port includes a valve responsive to pressure changes in the intake port and permitting vapor flow from the evaporative emissions canister into the intake port when a vacuum condition is present in the intake port. The valves prevent flow from the intake port to the evaporative emissions canister when a vacuum is not present in the intake port.

17 Claims, 3 Drawing Sheets

CANISTER PURGE SYSTEM

TECHNICAL FIELD

This invention relates to evaporative emission control systems for internal combustion engines, and, in particular, to an evaporative emission canister purge system for throttleless internal combustion engine intake systems.

BACKGROUND OF THE INVENTION

Evaporative emission control or fuel vapor recovery systems have been used in many vehicles in recent years. Such systems include a vapor storage canister that receives and stores fuel vapors emitted from the engine fuel system. Such canisters contain a material such as activated charcoal to absorb and store vapors from the fuel tank. Vacuum within the intake manifold of the engine is utilized to purge the vapors from the canister into the engine induction system during operation of the internal combustion engine.

In recent years, throttleless intake systems have been developed to increase fuel economy. Unlike a conventional spark ignition engine wherein power output is controlled by a throttle valve in the intake tract that produces a vacuum, throttleless intake systems do not provide an appreciable vacuum within the intake manifold. Due to the lack of vacuum within the intake manifold, known evaporative emission control systems do not operate properly with such a throttleless internal combustion engine intake system.

SUMMARY OF THE INVENTION

One aspect of the present invention is to provide a canister purge system for throttleless internal combustion engine intake systems. The canister purge system includes a plurality of purged ports, each of which is adapted for connection to an intake port of an internal combustion engine. An evaporative emissions canister is in fluid connection with each purge port. Each purge port includes a valve responsive to pressure changes in the intake port and permitting vapor flow from the evaporative emissions canister into the intake port when a vacuum condition is present in the intake port. The valves prevent flow from the intake port to the evaporative emissions canister when a vacuum is not present in the intake port.

Another aspect of the present invention is a purge system for internal combustion engines including a plurality of intake ports configured to flow air to the combustion chambers of an internal combustion engine. A plurality of intake valves are associated with the intake ports for selectively controlling flow into the combustion chambers. A purge port is in fluid communication with each of the intake ports, and an evaporative emissions canister is in fluid communication with each of the intake ports. A valve is associated with each purge port, and the valves are configured to selectively control vapor flow from the evaporative emissions canister through the purge ports and into the intake ports based at least in part upon the magnitude of the pressure within the intake ports.

Yet another aspect of the present invention is a method for purging vapors from an evaporative emissions container that is operatively connected to an internal combustion engine of the type having an intake tract lacking a throttle valve such that the pressure within the intake ports fluctuates due to opening and closing of the intake valves. The method includes providing a valve for at least a selected one of the intake ports. The valve is operatively connected to an evaporative emissions canister, and the valve is actuated in response to pressure fluctuation in the intake port to selectively permit flow of vapor from the evaporative emissions canister into the intake port.

These and other features, advantages and objects of the present invention will be further understood and appreciated by those skilled in the art by reference to the following specification, claims and appended drawings.

BRIEF DESCRIPTION OF THE DRAWINGS

The present invention will now be described, by way of example, with reference to the accompanying drawings, in which.

DESCRIPTION OF THE PREFERRED EMBODIMENT

Figure 1:
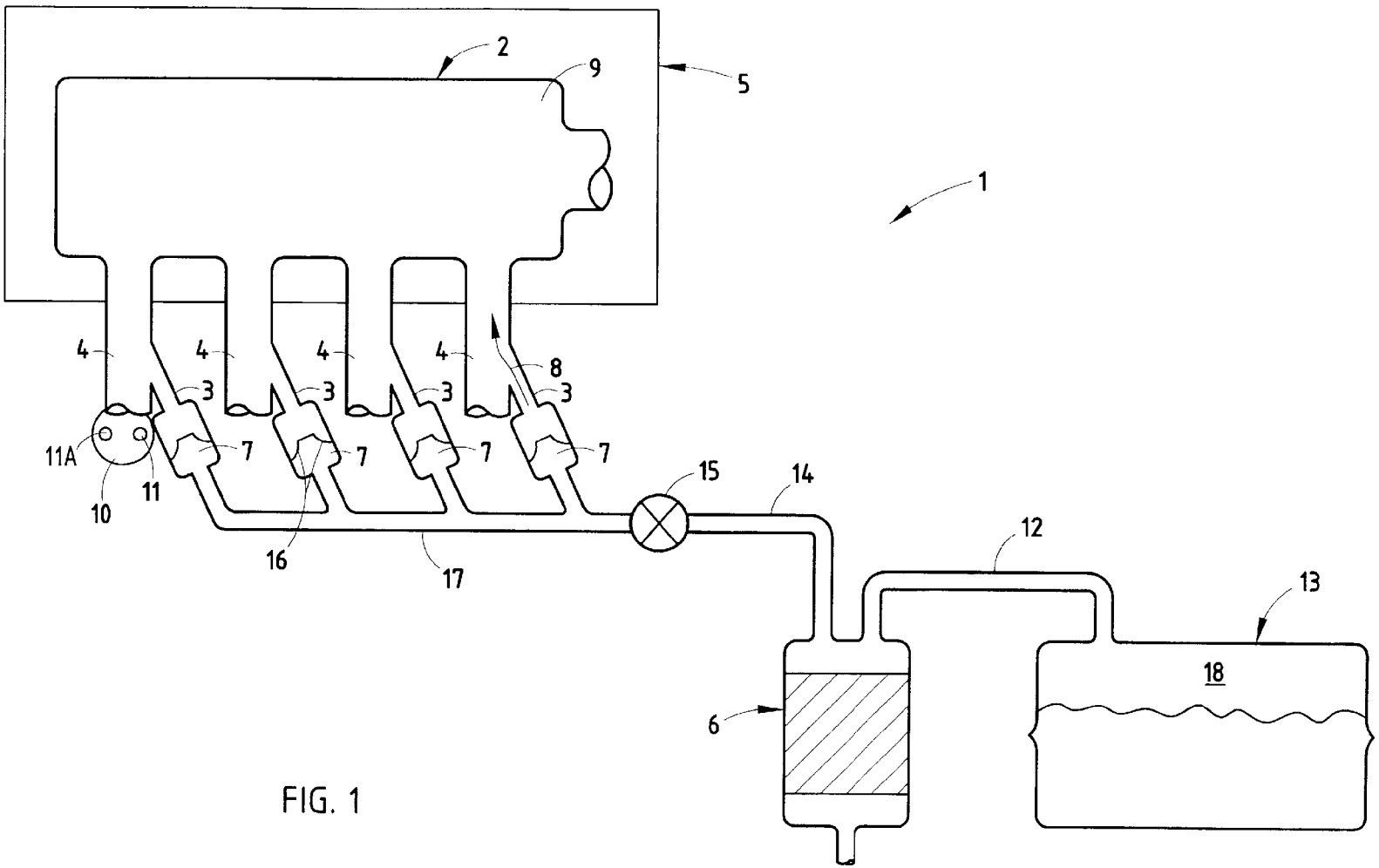
FIG. 1 is a schematic view of a canister purge system for throttleless internal combustion engine intake systems embodying the present invention.

With reference to FIG. 1, a canister purge system 1 for a throttleless internal combustion engine system 2 includes a plurality of purge ports 3. Each of the purge ports 3 is adapted for connection to an intake port 4 of an internal combustion engine 5. An evaporative emissions canister 6 is in fluid communication with each purge port 3. Each purge port 3 includes a valve 7 that is responsive to pressure changes in the intake port 4, and permits vapor 8 to flow from the evaporative emissions canister 6 into the intake port 4 when a vacuum condition is present in the intake port 4. Valves 7 prevent flow from the intake port 4 to the evaporative emissions canister 6 when a vacuum is not present in the intake port 4.

The throttleless internal combustion engine 5 illustrated schematically in FIG. 1 may be an engine of any one of various known engines that lack a throttle valve that would otherwise provide a vacuum in an intake manifold 9. Because throttleless internal combustion engines are known in the art, engine 5 will not be further described in detail herein. As is also known in the art, intake manifold 9 includes a plurality of intake ports 4, each of which is connected to a combustion chamber 10 having one or more intake valves 11 and exhaust valves 11*a*, each of which is also illustrated schematically in FIG. 1. Each of the purge ports 3 are preferably connected to the intake ports immediately adjacent the intake valves 11. In the illustrated example, the purge port is located about 5.0–8.0 cm (about 2.5 inches) from the valve seat. However, the precise location of purge ports 3 will depend upon the configuration of the intake ports 4, combustion chamber 10, valves 11, and related components.

During operation of the throttleless engine 5, small pressure fluctuations or pulsations occur in the area of the intake port 3 immediately upstream of the intake valve or valves 11. As the intake valve 11 opens, the sudden flow of air into the cylinder causes the pressure to briefly drop to a level slightly below atmospheric. When the valve 11 closes, the inertia of the moving air in the port 4 causes the pressure to briefly rise above atmospheric pressure. Although the average pressure over time is roughly equal to atmospheric pressure, the magnitude of the fluctuations may be as much as several centimeters of water.

A vapor pipe or tube 12 connects a vehicle gas tank 13 to the evaporative emissions canister 6 to convey vapors 18 from the tank. The vapors are absorbed by the active ingredient, such as activated charcoal, in the evaporative emissions container 6. A purge pipe or tube 14 is also connected to the evaporative emissions container 6, and leads to each of the purge ports 3. A flow control valve 15 is located in the purge tube 14 between the evaporative emissions canister 6 and the purge ports 3. Flow control valve 15 may be adjusted to control the total volume of flow from the canister 6 to the purge ports 3.

Each of the valves 7 are preferably reed valves of a known construction having flexible flaps 16 made of a durable polymer material that resists degradation when exposed to the vapors. Valves 7 are somewhat similar in construction to reed valves utilized in conventional canister purge systems, except that the flexibility of flaps 16 and overall size of valve 7 is chosen to provide to desired one way flow upon vacuum under the operating conditions present in throttleless intake systems. As described in more detail below, the valves 7 are preferably positioned as close to the intake valve as possible, and permit vapor flow towards the intake port 4 when a vacuum is present in port 4, but prevent backflow from the intake port 4 through the purge ports 3.

Figure 2:
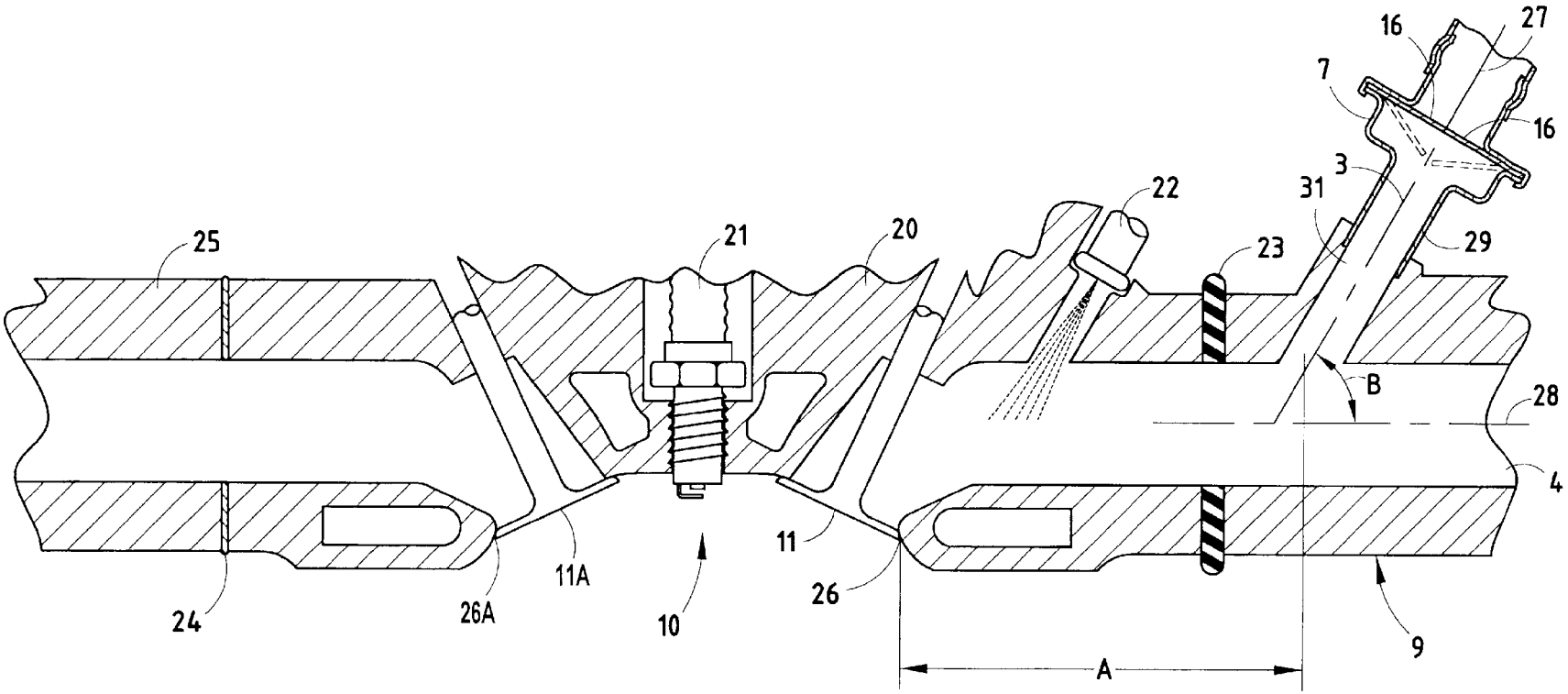
FIG. 2 is a fragmentary, cross-sectional view of a first embodiment of a canister purge system according to one aspect of the present invention.

FIG. 2 is a cross-sectional view of a first embodiment of the canister purge system showing the location of the valves 7. Internal combustion engine 5 includes a cylinder head 20 having a fuel injection nozzle 22, and a spark plug 21. Gaskets 23 and 24 seal the intake manifold 9, and exhaust manifold 25, respectively, at the interface with the cylinder head 20. Intake valves 11 and exhaust valves 11*a* seal against valve seats 26 and 26*a* to selectively control flow into and out of combustion chamber 10. In the illustrated example, the center line 27 of purge port 3 intersects the intake port 4 at a distance "A" of about 5–6 cm from the valve seat 26. Also, in the illustrated example, the center line 27 of purge port 3 intersects center line 28 of intake port 4 at an angle "B" of about 60°. However, the angle "B" could be substantially smaller for some applications, such as, for example, 45°, or 30°. The tubular housings 29 of valves 7 are press-fit, threaded, or otherwise fixed in opening 31 of intake manifold 9. Placement of the purge port 3 directly adjacent the intake valve 11 ensures that sufficient vacuum is generated to operate the valve 7.

Figure 3:
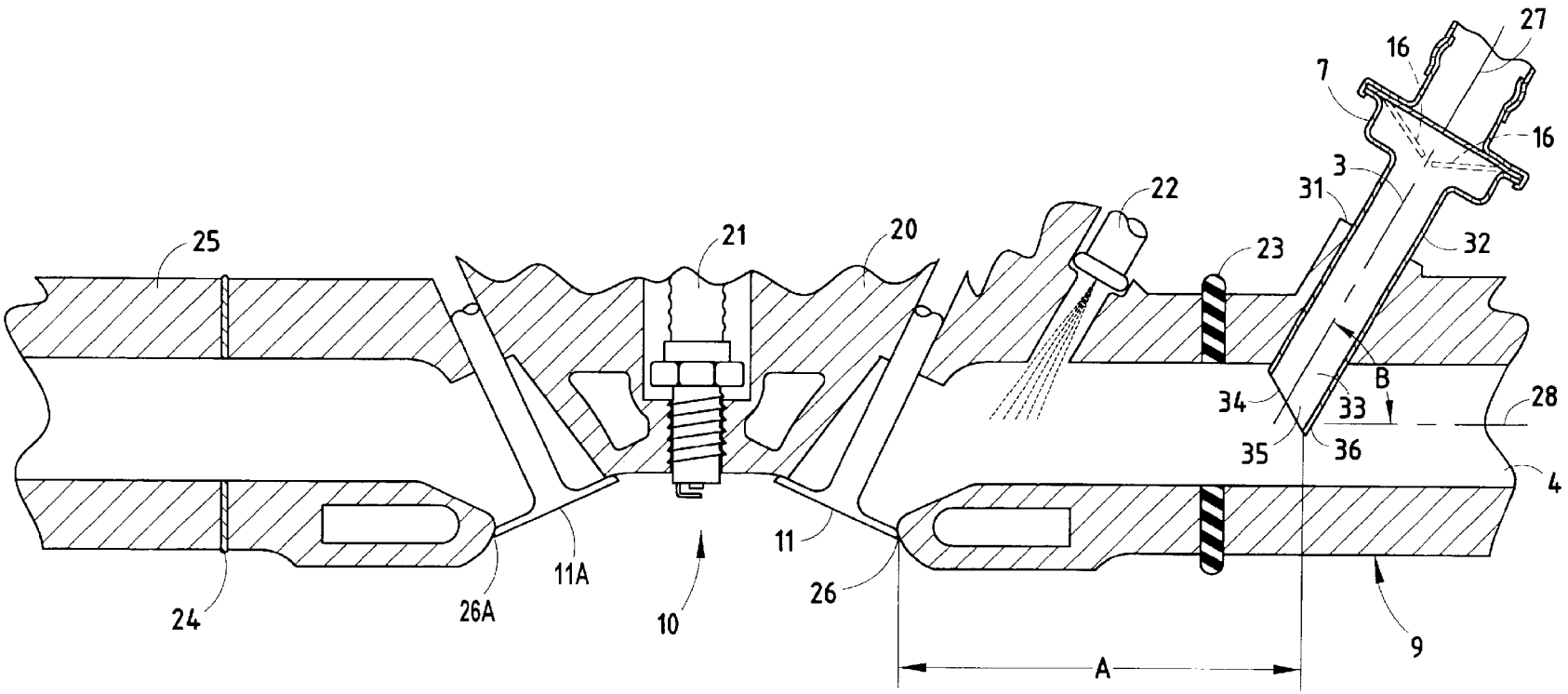
FIG. 3 is a fragmentary, cross-sectional view of a second embodiment of a canister purge system according to another aspect of the present invention.

Another embodiment of the canister purge system is illustrated in FIG. 3. The system of FIG. 3 is substantially similar to that of FIG. 2, except that valve 7 includes an elongated tubular portion 32 that extends through the opening 31 in intake manifold 9. Edge 34 of tip 33 of tube 32 extends at a non-orthogonal angle relative to the center line 27 of purge port 3, such that opening 35 of tube 32 is generally positioned downstream of the endmost sidewall 36 of tube 32. Purge port 3 illustrated in FIG. 3 is preferably located at a distance "A" of about 5–6 cm from the valve seat 26. Also, the center line 27 of purge port 3 forms an angle "B" relative to the center line 28 of intake port 4 of about 60°, although this angle could vary as discussed above with respect to the embodiment illustrated in FIG. 2.

During operation, the intermittent sub-atmospheric pressure fluctuations present in the intake ports 4 induce flow 8 through the purge ports 3 and reed valves 7. The intermittent fluctuations above atmospheric pressure cause the reed valves 7 to close, such that no flow is permitted out from the purge manifold 17. During operation, the pressure in purge manifold 17 drops to a relatively constant level slightly below atmospheric pressure, and this lower pressure condition purges the canister 6 in a manner that is substantially similar to a conventional system, even though the average pressure in the intake manifold 9 is nominally atmospheric. The flow control valve 15 permits the flow of purge vapor to be reduced below the maximum value, or even stopped if operating conditions so require. Flow control valve 15 may be operatively connected to an electronic engine control unit ("ECU") to provide automatic adjustment during operation based upon operating conditions.

The canister purge system of the present invention permits purging of an evaporative emissions canister in throttleless internal combustion engines, without requiring a vacuum pump or blower or other restriction in the intake tract that would otherwise be required to generate a vacuum condition. Although a "strangler" or other restriction could be placed in the intake manifold 9 to generate vacuum, such a restriction would likely at partially nullify the fuel economy benefits of an unthrottled engine. Although the canister purge system 1 is illustrated in connection with a four cylinder engine, the system could be utilized with an internal combustion engine having any number of cylinders by providing the proper number of valves 7 and purge ports 3, and operatively connecting the purge ports 3 to the canister 6. The canister purge system 1 of the present invention is inexpensive, and does not require pumps or other such devices that would otherwise drain power from the engine.

It will be understood by those who practice the invention and those skilled in the art, that various modifications and improvements may be made to the invention without departing from the spirit of the disclosed concept. The scope of protection afforded is to be determined by the claims and by the breadth of interpretation allowed by law.

What is claimed is:

1. A canister purge system for throttleless internal combustion engine intake systems; comprising:

a plurality of purge ports, each adapted for connection to an intake port of an internal combustion engine;

an evaporative emissions canister in fluid connection with each said purge port; and each purge port including a valve responsive to pressure changes in the intake port and permitting vapor flow from said evaporative emissions canister into the intake port when a vacuum condition is present in the intake port, and preventing flow from the intake port to the evaporative emissions canister when a vacuum is not present in the intake port.

2. The canister purge system set forth in claim 1, wherein:

said valves comprise reed valves.

3. The canister purge system set forth in claim 2, wherein:

said evaporative emissions canister includes activated carbon to absorb fuel vapors.

4. The canister purge system set forth in claim 3, including:

tubing connecting said reed valves to said evaporative emissions canister; and a flow control valve operatively connected to said tubing to control flow between said reed valves and said evaporative emissions canister.

5. The canister purge system set forth in claim 4, including:

a fuel tank in fluid connection with said evaporative emissions canister.

6. The canister purge system set forth in claim 5, including:

a throttleless intake system having an intake manifold with a plurality of intake ports connected to said purge ports.

7. The canister purge system set forth in claim 6, including:

a combustion chamber connected to each said intake port, including an intake valve controlling flow from said intake port into said combustion chamber, said purge ports connected to said intake ports immediately adjacent said intake valves.

8. A purge system for internal combustion engines, comprising:

a plurality of intake ports configured to flow air to the combustion chambers of an internal combustion engine;

a plurality of intake valves associated with said intake ports for selectively controlling flow into the combustion chambers;

a purge port in fluid communication with each said intake port;

an evaporative emissions canister in fluid communication with each said intake port; and a valve associated with each said purge port, each valve configured to selectively control vapor flow from said evaporative emissions canister through said purge ports and into said intake ports based at least in part upon the magnitude of the pressure within said intake ports.

9. The purge system set forth in claim 8, wherein:

said valves comprise one way valves that permit flow through said purge port when a vacuum condition is present in said intake ports.

10. The purge system set forth in claim 9, wherein:

said valves comprise reed valves.

11. The purge system set forth in claim 10, wherein:

said evaporative emissions canister includes activated carbon to absorb fuel vapors.

12. The purge system set forth in claim 11, including:

tubing connecting said reed valves to said evaporative emissions canister; and a flow control valve operatively connected to said tubing to control flow between said reed valves and said evaporative emissions canister.

13. The purge system set forth in claim 11, including:

a fuel tank in fluid connection with said evaporative emissions canister.

14. A method for purging vapors from an evaporative emissions container that is operatively connected to an internal combustion engine of the type having an intake tract lacking a throttle valve such that the pressure within the intake ports fluctuates due to opening and closing of the intake valves; said method comprising the steps of:

providing a valve for at least a selected one of the intake ports;

operatively connecting the valve to an evaporative emissions canister;

actuating the valve in response to a pressure fluctuation in said intake port to selectively permit flow of vapor from said evaporative emissions canister into said intake port.

15. The method of claim 14, wherein:

said valve is actuated in response to a vacuum condition in said intake port.

16. The method of claim 14, wherein:

said valve is a one way valve that opens to permit flow into said intake port when a vacuum condition is present in said intake port, and closes to prevent such flow when a generally atmospheric pressure condition exists in said intake port.

17. The method of claim 16, wherein:

a flow control valve is operatively connected to said evaporative emissions container; and said flow control valve is selectively adjusted to control vapor flow from said canister to said one way valve.

* * * * *